US006640065B1

(12) United States Patent
Yuge

(10) Patent No.: US 6,640,065 B1
(45) Date of Patent: Oct. 28, 2003

(54) ELECTROSTATIC CHARGING DEVICE

(75) Inventor: Keiji Yuge, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 14 days.

(21) Appl. No.: 10/118,373

(22) Filed: Apr. 9, 2002

(51) Int. Cl.[7] ..... G03G 15/02

(52) U.S. Cl. ..... 399/100; 250/324; 361/225; 399/173

(58) Field of Search ..... 399/100, 168, 399/170, 171, 172, 173; 250/324, 325; 361/225, 230

(56) References Cited

U.S. PATENT DOCUMENTS

| | | | | |
|---|---|---|---|---|
| 3,887,809 A | * | 6/1975 | Marx et al. | 250/324 |
| 4,371,252 A | * | 2/1983 | Uchida et al. | 361/225 X |
| 4,788,573 A | * | 11/1988 | Nakaoka et al. | 399/100 |
| 5,229,819 A | * | 7/1993 | Beresniewicz et al. | 399/172 |
| 5,532,798 A | * | 7/1996 | Nakagami et al. | 399/100 X |
| 5,666,605 A | * | 9/1997 | Tokimatsu et al. | 399/173 |
| 5,845,179 A | * | 12/1998 | Damji et al. | 399/173 |
| 5,909,608 A | * | 6/1999 | Manno et al. | 399/173 |
| 6,025,594 A | * | 2/2000 | Bryce et al. | 250/324 |

FOREIGN PATENT DOCUMENTS

| | | |
|---|---|---|
| JP | 7-234570 | 9/1995 |

* cited by examiner

*Primary Examiner*—Fred L. Braun
(74) *Attorney, Agent, or Firm*—Foley & Lardner

(57) ABSTRACT

An electrostatic charging device is provided according to which an edged electrode plate can be inserted into and removed from the charging device easily merely by sliding the edged electrode member and cleaning of the electrode edges formed on the edged electrode plate can be cleaned easily. A discharging electrode assembly having a number of tooth-like electrode edges disposed in array is slidable along a guide groove formed in a discharge stabilizing shielding case of an electrostatic charging device. The electrode edges are arranged above a control grid when charging a photosensitive OPC. During maintenance, the discharging electrode assembly is moved sliding along the guide groove by means of an insulating attachment which is then engaged with the edged electrode plate. During this movement, the edged electrode plate is sandwiched by a pair of rotatable rollers which are then driven to rotate by the sliding movement, so that electrode edges attached with carbon particles due to corona discharging can be cleaned. Thus, the discharging electrode assembly can be inserted and removed easily with the electrode edges thereof being cleaned simultaneously without removing a charger case or the control grid from the device proper.

12 Claims, 5 Drawing Sheets

ELECTROSTATIC CHARGING DEVICE

BACKGROUND OF THE INVENTION

1. Field of the Invention

The present invention relates to an electrostatic charging device for charging a photosensitive drum of an electrophotographic apparatus by utilizing corona discharge, and more particularly to a structure which enables removal and replacement of a corona discharging electrode.

2. Description of the Related Art

As a photosensitive body for use in an electrophotographic apparatus, an organic photo conductor (OPC) is employed increasingly every year for its advantages in terms of cost, safety and wavelength selectivity. Most of the electrophotographic apparatuses marketed as new products in recent years use an OPC of negative charge type. An electrostatic charging device has been known as an apparatus for providing a negative charge to the OPC. The charging device can be grouped into a contact type and a non-contact type depending on whether the device is in contact with the OPC or not, and each type has advantages and disadvantages, so that appropriate type is selected for use, accordingly. The charging device of non-contact type utilizes mainly corona discharging and, therefore, such device is called a corona discharging device. Scorotron-type corona discharging device is used predominantly for its advantage in charge stability. In the charging device of scorotron-type, OPC charging is controlled by application of voltage with a magnitude of thousands of volts to the control grid.

Deterioration or fouling of discharging electrode of the corona discharging device causes irregular corona discharging and hence uneven charge potential on the OPC surface, with the result that troubles with image formation that is the basic function of the electrophotographic apparatus will be invited. The discharging electrode of the corona discharging device is subjected to application of high voltage, and therefore, the electrode has a serviceable life which is shorter than that of the electrophotographic apparatuses itself, so that generally the corona discharging device is replaced as a whole or as a process unit. As the discharging electrode of the non-contact type corona discharging device, two types of electrode are available including wire type and edge type (also referred to as sharp pin type) are available, both of which are used extensively. Especially, an edged electrode plate used for charging by the corona discharging device is made of thin metal sheet and formed with an array of sharp edges disposed in a sawtooth-like arrangement.

When changing the edged electrode plate because of deterioration of the electrode edges or for any other reason, it has been a conventional practice to remove the entire corona discharging device (i.e. charging device) from the process unit of the electrophotographic apparatus and then change the faulty edged electrode plate by disassembling the charging device, thus the procedure for the replacement of the edged electrode plate having being quite troublesome. Specifically, many of the charging devices such as corona discharging device operable by utilizing corona discharging are of scorotron type which uses both edged electrode plate and the control grid for controlling the charge, so that it is necessary to remove the control grid in changing the edged electrode plate. The control grid is provided with a thin mesh plate which is difficult to handle, and there is a fear that the control grid may be deformed during changing of the edged electrode plate.

SUMMARY OF THE INVENTION

The present invention has been made in light of the above-described problems and, therefore, it is an object of the invention to provide an electrostatic charging device, which is capable of allowing the edge electrode plate to be inserted into and removed from the charging device easily merely by slidably moving only the edged electrode plate.

In order to achieve the object, there is provided a electrostatic charging device for charging a photosensitive drum, which comprises an edged electrode member (or discharging electrode) having a plurality of tooth-shaped electrode edges arranged in array along a longitudinal direction of and in facing relation to said photosensitive drum, a discharge regulating member (or discharge stabilizing shielding case) for regulating the region of corona discharging so that the corona discharge generated from said electrode edges is directed along the longitudinal direction of said photosensitive drum, and a mechanism for removably installing said edged electrode member in said discharge regulating member by slidably moving said edged electrode member relative to said discharge regulating member in a longitudinal direction thereof. With the arrangement being such that, the edge electrode member can be inserted into and removed from the charging device easily merely by slidably moving only the edged electrode member.

According to the present invention, the charging device may include a control grid for controlling the condition of charging the photosensitive drum by the corona discharge. With a conventional charging device of scorotron-type, the control grid must be removed in replacing the edged electrode member and the electrode member replacement has been a troublesome work. According to the invention, however, the replacement does not require the removal of the control grid, thus the effect of the invention is remarkable in this respect.

In the charging device of the invention, the mechanism for removably installing the edged electrode member includes a structure for supporting the edged electrode member, which is provided in the form of a plate, in such a way that the edged electrode plate is insertable and removable with respect to a guide groove formed in the discharge regulating member. Thus, the mechanism for removably installing the edged electrode member can be constructed simple.

Furthermore, the discharge regulating member of the charging device according to the present invention may be supported by a cleaning process unit for cleaning the photosensitive drum by removing residual toner. Alternatively, the discharge regulating member may be supported by the body of an electrophotographic apparatus which has incorporated therein the cleaning process unit.

In the charging device according to the invention, the edged electrode member has an engagement portion (or groove) which is engageable with an insulating attachment and removably inserted into the discharge regulating member by means of the attachment.

According to the invention, the edged electrode member is made of stainless steel and includes an electrode holder (or electrode plate holder) made of insulating material including PPE and polycarbonate, and the edged electrode member is made integral with the electrode holder as a replaceable part.

The edged electrode member includes a plurality of replaceable units of electrode each having a single or a plurality of the tooth-shaped electrode edges and an electrode support which detachably supports such replaceable units of electrodes. This electrode support is conductive with the above replaceable units of electrode so that all such units of electrode are applied with the same voltage.

Still furthermore, according to the present invention, there is provided a rotatable roller adjacent to an opening through which the edged electrode member is inserted for cleaning the edged electrode member when being rotated by sliding movement of the edged electrode member. The rotatable cleaning roller includes at least a pair of such rollers which are disposed so as to sandwich therebetween the edged electrode member. Additionally, the discharging device includes a scraper for scraping off fouling substances from the rotatable roller.

DESCRIPTION OF THE DRAWINGS

FIG. 8(*b*) is a perspective view showing the rotatable rollers and the scraper;

FIG. 9(*b*) is a view showing an edged electrode plate, wherein one electrode edge is replaceable as a unit part.

DESCRIPTION OF THE PREFERRED EMBODIMENT

The following will describe an embodiment of the invention by way of a corona discharging device as an example which is used for charging a photosensitive body of an electrophotographic apparatus while having reference to the drawings. The embodiment of the charging device according to the invention is so constructed that replacement of discharging electrode can be performed easily by replacement of a less number of parts. More specifically, it is so arranged that the replacement can be accomplished merely by removing the discharging electrode from the charging device.

Figure 1:
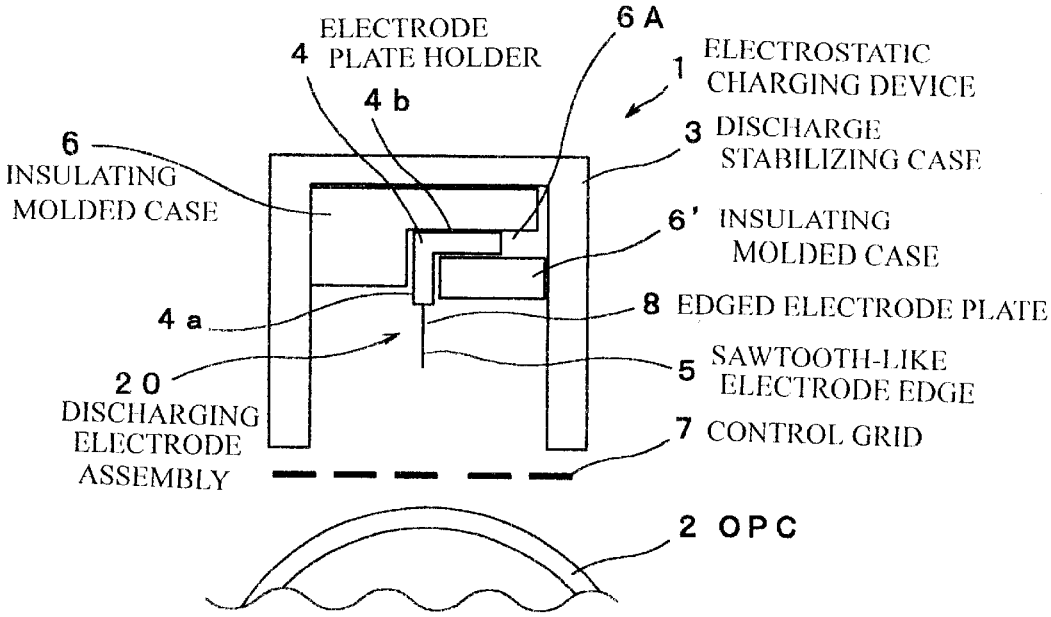
FIG. 1 is a schematic cross-sectional view showing the basic structure of an electrostatic charging device according to the present invention applicable to an electrophotographic apparatus.
Figure 2:
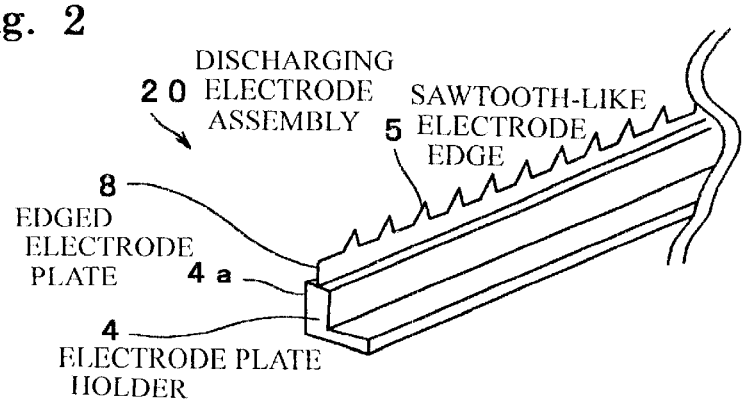
FIG. 2 is a perspective view showing a first embodiment of an edged electrode plate in the charging device according to the present invention.

FIG. 1 is a schematic cross-sectional view showing the basic structure of an electrostatic charging device according to the present invention applicable to an electrophotographic apparatus, and FIG. 2 is a perspective view showing a first embodiment of an edged electrode plate in the charging device according to the present invention. The charging device 1 is disposed in facing relation to an OPC 2 and extends along the longitudinal direction of the OPC 2, or in the direction perpendicular to the plane of the drawing. The charging device shown in FIG. 1 includes a discharge stabilizing case or shielding case 3 with an inverted channel shape in cross-section for shielding the area of discharge by corona discharging so that the discharging occurs in the area along the longitudinal direction of the OPC 2, a discharging electrode assembly 20 disposed within the recess defined by the shielding case 3 for generating corona discharge, insulating molded cases 6, 6' supporting the discharging electrode assembly 20 slidably in a guide groove 6A, and a control grid 7 disposed between the shielding case 3 and the OPC 2 for controlling the charge potential of the OPC 2.

The discharging electrode assembly 20 includes a conductive edged electrode plate 8 having formed on the side thereof facing the OPC 2 a plurality of sawtooth-like electrode edges 5 and a electrode plate holder 4 which is made of insulating material and to which the edged electrode plate 8 is fixedly mounted.

The electrode plate holder 4 is provided by a plate with an L-shape cross-section, having an electrode supporting portion 4*a* having mounted to the end thereof the edged electrode plate 8 and a slide portion 4*b* inserted in the guide groove 6A between the insulating molded cases 6, 6' for supporting the discharging electrode assembly 20 slidably along the guide groove 6A. The electrode plate holder 4 is made of any suitable insulating material, for example PPE or polycarbonate for the purpose of improved insulation, strength and slidability.

On the other hand, the guide groove 6A, which is defined between the insulating molded cases 6, 6', is formed in such a way as allowing the slide portion 4*b* to be slidably supported in a space having a predetermined width (or a width that is large enough to slidably support the slide portion 4*b*) as measured in the direction toward the OPC 2 and allowing the electrode supporting portion 4*a* to be slidable with a clearance with respect to the wall surfaces of the insulating molded cases 6, 6'.

Figure 3:
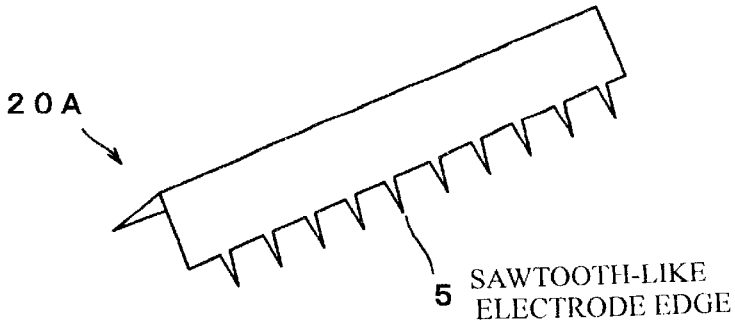
FIG. 3 is a perspective view showing a second embodiment of an edged electrode plate in the charging device according to the present invention.

As an alternative form of the discharge electrode assembly, it may be L-shaped and the edged electrode plate and the electrode plate holder may be formed as an integral unit as shown in FIG. 3. In such a case, the discharging electrode 20A may be made only of a conductive metal plate and, therefore, can be realized at a reduced cost.

The shielding case 3 is disposed extending along the longitudinal direction of the OPC 2 with an end thereof opened through which the discharging electrode assembly 20 may be inserted and removed, thus the discharging electrode assembly 20 being detachably installable in the charging device 1. The shielding case 3 serves to regulate the direction of the corona charge generated by the edged electrode plate 5 so as to flow within the recess defined by the shielding case 3, so that charging of the surface of the OPC 2 can be effected with high efficiency.

As a method of power supplying to the edged electrode plate 8, a contact point which is, e.g., in the form of a leaf spring and to which power is connected may be provided adjacent to the inserted end of the discharging electrode assembly 20 in the shielding case 3 so that the end of the discharging electrode assembly 20 is brought into resiliently pressing contact against the leaf spring as the contact point when the discharging electrode assembly 20 is inserted in place.

Figure 4:
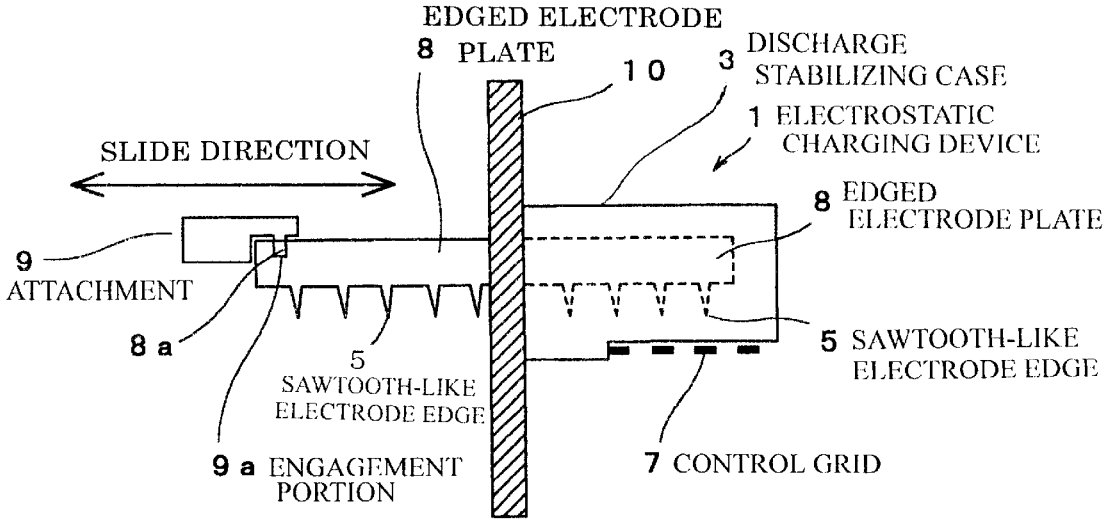
FIG. 4 is an illustrative view showing a manner in which the edged electrode plate is inserted into and removed from the charging device of the invention by using an insulating attachment.

FIG. 4 is an illustrative view showing a manner in which the discharging electrode assembly 20 is inserted into and removed from the charging device 1 by using an attachment made of an insulating material. The charging device 1 of the present invention is installed such that an end of its shielding case 3 is fixedly mounted to a suitable mounting 10 of a cleaning process unit or the electrophotographic apparatus in which the cleaning process unit is incorporated.

In the drawing of FIG. 4, the portion on the right-hand side thereof as seen from the mounting 10 shows a state in which the discharging electrode assembly 20 is installed in the charging device 1, while the left-hand side portion with respect to the shielding case 3 shows a state in which the discharging electrode assembly 20 is removed from the charging device 1. Insertion and removal of the discharging electrode assembly 20 is accomplished by inserting and removing the discharging electrode assembly 20 through the mounting 10 into and from the guide groove 6A (FIG. 1) which is formed along the longitudinal direction of the OPC 2.

In the illustrated embodiment, the edged electrode plate 8 is formed at one end thereof with a groove 8*a* as an engagement portion engageable with the attachment 9 and, in removing the discharging electrode assembly 20 from the charging device 1 for changing of the discharging electrode assembly 20 or for the maintenance, the attachment 9 is inserted through an opening in the end of the shielding case 3 of the charging device 1 so as to engage an engagement portion 9*a* formed at the tip end of the attachment 9 with the groove 8*a* of the edged electrode plate 8, and the edged electrode plate 8 may be withdrawn out of the shielding case 3. The attachment 9 is a tool which is made of insulating material and designed to withdraw the edged electrode plate 8 out of the shielding case 3. The end of the shielding case 3 (or the above-mentioned opening in the end of the shielding case 3) through which the attachment 9 is inserted is provided with an insulating member (not shown) for prevention of electrical shock.

Figure 5:
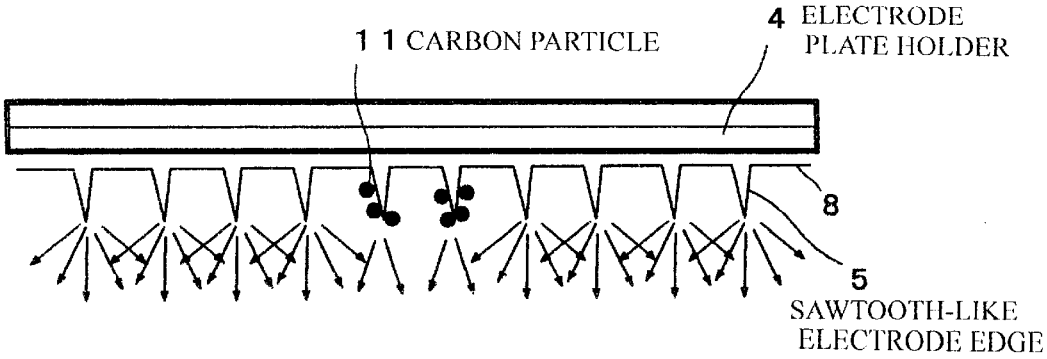
FIG. 5 is an illustrative view showing a state in which carbon particles are attached to the electrode edges and irregularity in discharging occurs accordingly.

FIG. 5 is an illustrative view showing a state in which carbon particles are attached to the edged electrode plate and irregularity in discharging occurs accordingly.

As depicted in FIG. 5, the electrode edges 5 having carbon particles 11 attached thereto generate only weak corona discharge, while the electrode edges 5 free from attachment of carbon particles 11 generate strong corona discharge. If irregularity in discharging occurs due to the attachment of carbon particles 11 to the electrode edges 5, the discharging electrode assembly should be cleaned for continued use thereof without changing the electrode assembly.

Generally, in a charging device utilizing corona discharge, the tip ends of the electrode edges will be fouled by continued corona discharging, thereby resulting in charge irregularity. As simplified method for preventing such irregularity, the electrode edges may be cleaned by any suitable cleaning device, but, as compared with wire-type electrode, installation of a cleaning device in the above charging device is difficult because of deformation of the electrode edges by cleaning and also of a limited space for the installation.

Japanese Patent Application KOKAI Publication No. H7-234570 discloses an electrostatic charging device, or a corona discharging device, having an edged electrode plate formed with electrode edges and having the opposite ends thereof fixedly held. This corona discharging device has a cleaning device for cleaning the electrode edges arranged in array along the longitudinal direction of the edged electrode plate by means of rotatable cleaning rollers which are adapted to clean the opposite sides of the electrode edges by sliding movement along the sides of the electrode edges. In the corona discharging device of such construction, fouled edged electrode plate can be cleaned by sliding the cleaning device along the edged electrode plate without replacing the electrode plate and, therefore, the maintenance for cleaning can be done with high efficiency. For moving the cleaning device, however, the corona discharging device (or the electrostatic charging device) must be constructed to provide a space so that the cleaning device can slide for a distance corresponding to the length of the edged electrode plate, with the result that the apparatus will become large in size. Additionally, the mechanism for sliding the cleaning device is complicated and the sliding mechanism is susceptible to troubles caused by the complicated structure thereof.

In the embodiment according to the present invention, therefore, the charging device 1 is not only capable of permitting easy changing of the discharging electrode assembly 20 by slidably moving only such electrode assembly, but also of serving to facilitate the cleaning of the electrode edges formed on the edged electrode plate, so that the maintenance of the edged electrode plate can be accomplished easily.

Figure 6:
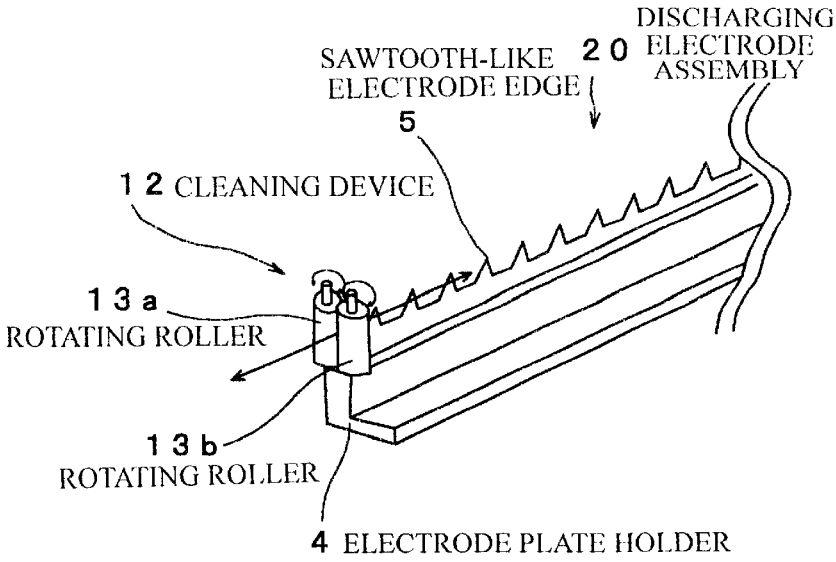
FIG. 6 is an illustrative perspective view showing a manner in which the edged electrode plate is being cleaned by rotatable rollers of a cleaning device in the charging device according to the present invention.
Figure 7:
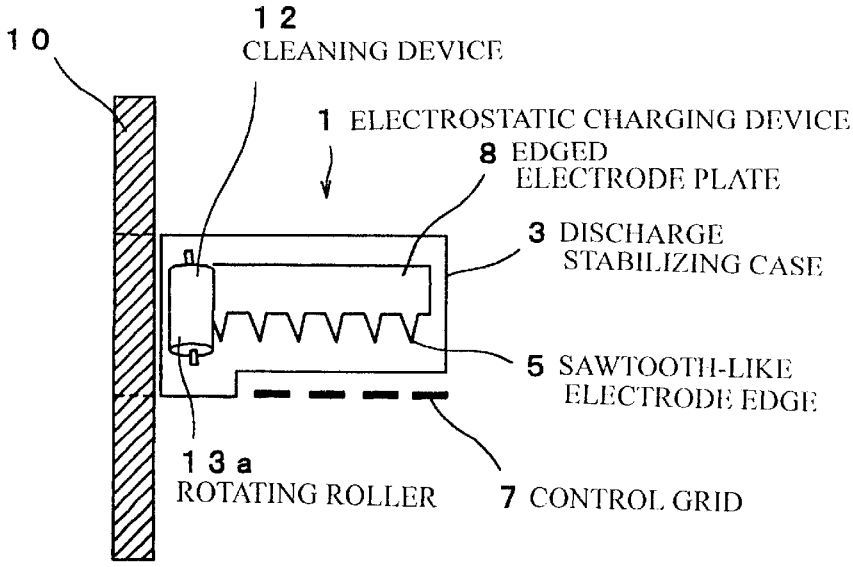
FIG. 7 is a view showing a state in which the charging device and the cleaning device of the invention are installed in the electrophotographic apparatus.

FIG. 6 is an illustrative perspective view showing a manner in which, in the embodiment of the electrostatic charging device, the edged electrode plate is being cleaned by rotatable cleaning rollers of cleaning device. FIG. 7 is a view showing a state in which the charging device according to the invention and the cleaning device are mounted to the shielding case. As shown in FIG. 6 and FIG. 7, the cleaning device 12 is provided adjacent to the opening formed in the mounting 10 through which the discharging electrode assembly 20 is inserted and removed, and includes a pair of rotatable cleaning rollers 13*a,* 13*b* which are disposed so as to sandwich the edged electrode plate 8 in contact with the opposite sides thereof. With such an arrangement, the paired rollers 13*a,* 13*b* are rotated in opposite direction while sandwiching the edged electrode plate 8 for cleaning the edged electrode plate 8 which is then moving and its electrode edges 5. The mechanism of the cleaning device 12 can be simplified over the conventional device, thus saving installation space and facilitating the maintenance procedure.

As the material for the cleaning rollers 13*a* and 13*b,* either a non-resilient hard material such as POM (polyacetal) or a resilient material such as CR (chloroprene) rubber may be used. In order to prevent slippage in rotation, it is desirable that the paired cleaning rollers 13*a,* 13*b* should be rotated at a peripheral speed corresponding to the sliding speed of the edged electrode plate 8. Allowing the paired rollers 13*a,* 13*b* to be rotated in opposite directions by the sliding motion of the edged electrode plate 8, a load applied to the sharp tip ends of the electrode edges 5 during cleaning can be reduced, so that deformation of the electrode edges at the tip ends thereof can be prevented successfully.

Figure 8:
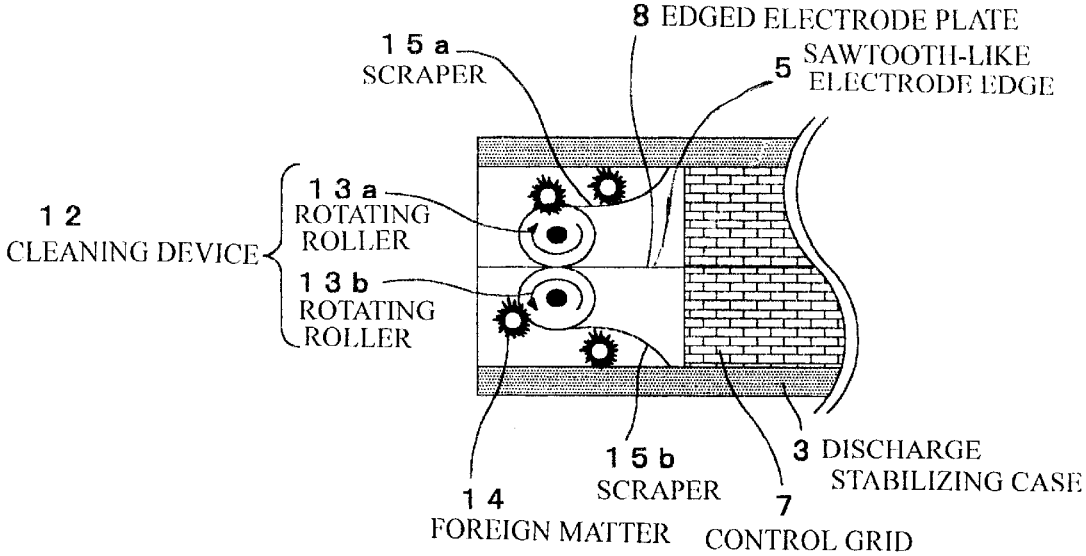
FIG. 8(*a*) is a schematic cutaway plan view as seen from the top of a shielding case, showing an arrangement in which a cleaning scraper is provided for the rotatable rollers of the cleaning device.
Figure 8:
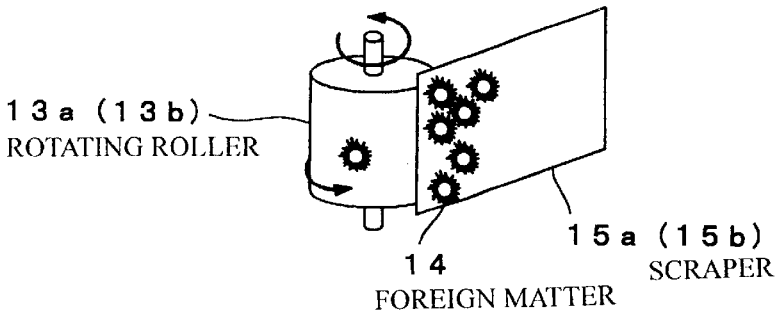

FIGS. 8(*a*) and 8(*b*) are schematic views showing an arrangement in which cleaning scrapers are provided for the cleaning rollers of the cleaning device, respectively, wherein FIG. 8(*a*) is a plan view as seen from the top of the shielding case and FIG. 8(*b*) is a perspective view showing the cleaning roller and the scraper. As shown in FIG. 8(*a*), the scrapers 15*a,* 15*b* have one ends thereof fixedly attached to the shielding case 3 and the other ends thereof placed in contact with the surfaces of the cleaning roller 13*a,* 13*b,* respectively.

Fouling foreign matters 14 collected by the electrode edges 5 are attached to the paired cleaning roller 13*a* (13*b*)

which cleans the edged electrode plate 8, but such foreign matters 14 are removed by the scraper 15*a* (15*b*), so that the surfaces of the cleaning roller 13*a* (13*b*) is kept clean at all times. Scraped foreign matters are attached to the scraper 15*a* (15*b*) and then dropped outside.

Because the scrapers 15*a,* 15*b,* which scrape away the foreign contaminant matters 14 adhered to the rotating rollers 13*a,* 13*b,* may be subjected to a so-called turning phenomenon, it is preferred that the scrapers 15*a,* 15*b* should be made of such material as PET (polyethylene terephthalate) and free of burr at the distal ends. It is also preferred that the surfaces of the cleaning rollers 13*a,* 13*b* in frictional contact with the scrapers 15*a,* 15*b* should have as low frictional resistance as possible. It is desirable therefore that smooth and slippery material, for example POM (polyacetal) or nylon, may be used.

Figure 9:
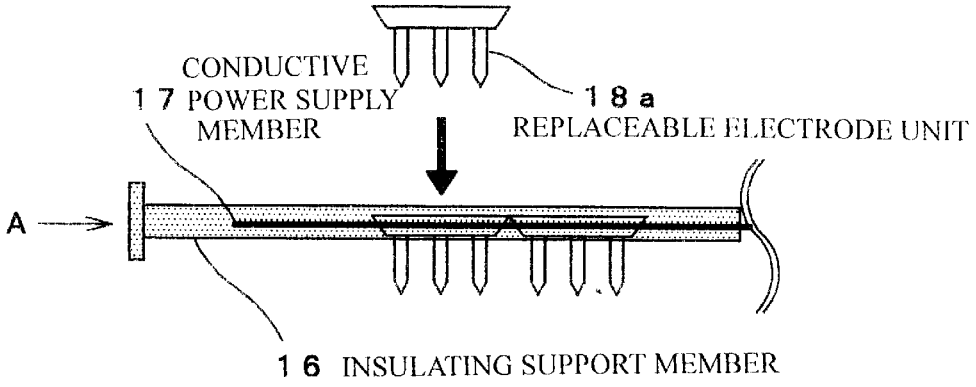
FIG. 9(*a*) is a side view of an edged electrode plate of the type in which one or a plurality of electrode edges is replaceable as a unit part, the drawing showing specifically an edged electrode plate, wherein three electrode edges are replaceable as a unit part.
Figure 9:
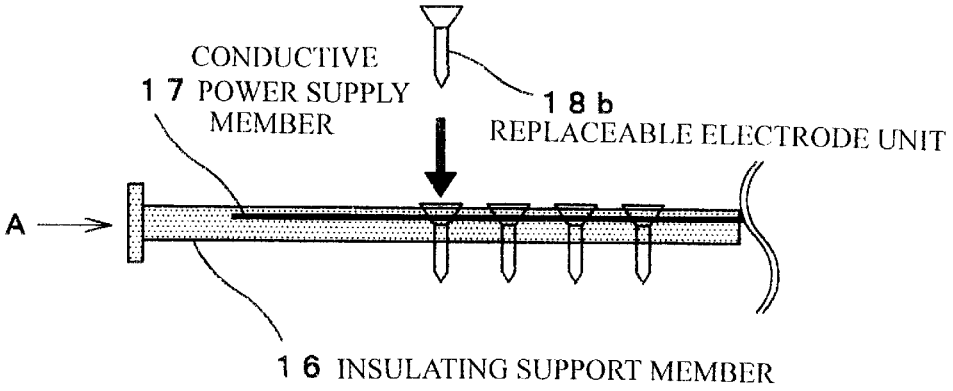
Figure 10:
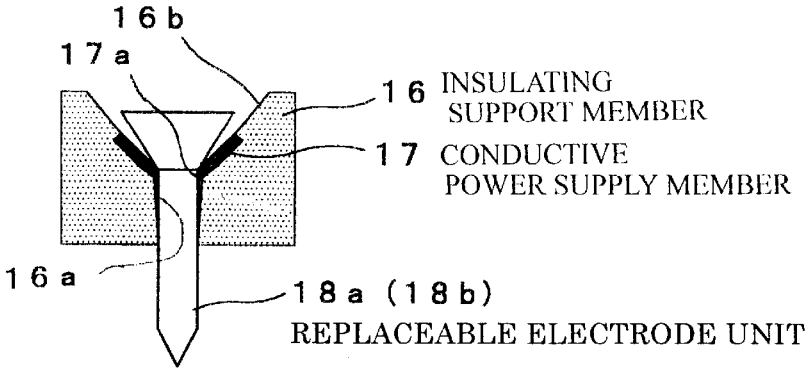
FIG. 10 is a cross-sectional view showing one electrode edge of replaceable type edged electrode plate.

FIG. 9(*a*) and FIG. 9(*b*) are views showing other embodiments of the edged electrode plate. The edged electrode plates shown in these drawings are designed to have replaceable electrodes as individual unit parts, each having a single electrode edge or a plurality of such electrode edges. FIG. 9(*a*) is a side view showing an edged electrode plate assembly having a plurality of replaceable electrode units (each having, for example, three electrode edges), while FIG. 9(*b*) is a side view showing an edged electrode plate assembly having a plurality of replaceable electrode units each having a single electrode edge. FIG. 10 is a view as seen in the arrow direction A in FIG. 9(*a*) and FIG. 9(*b*). In the embodiment of FIG. 9(*a*), the edged electrode plate assembly includes a plurality of replaceable electrode units 18*a* each having three electrode edges and mounted to a support member 16 made of insulating material, and the plural replaceable electrode units 18*a* are electrically connected with one another by means of a power supply member 17 made of conductive material. In the embodiment of FIG. 9(*b*), on the other hand, the edged electrode plate assembly includes a plurality of replaceable electrode units 18*b* each having a single electrode edge and mounted to the insulating support member 16, and the plural replaceable electrode units 18*b* are electrically connected with one another by means of the conductive power supply member 17. As shown in FIG. 10, the insulating support member 16 and the conductive power supply member 17 are formed with holes 16*a* and 17*a,* respectively, through which the replaceable electrode units 18*a* and 18*b* are inserted. The inlet of the hole 16*a* in the support member 16 is formed with a taper 16*b* so as to receive the heads of the electrode edges of the replaceable electrode units 18*a,* 18*b.* The conductive power supply member 17 has a width which is greater than the diameter of the hole and extends along the longitudinal direction of the insulating support member 16. When the replaceable electrode units 18*a,* 18*b* are inserted into the hole to such an extent that the head of the electrode units 18*a,* 18*b* sink to the bottom of the taper 16*b* of the hole, the conductive power supply member 17 is bent so as to conform to the shape of the head of the electrode units 18*a,* 18*b,* so that the area of contact between the conductive power supply member 17 and the replaceable electrode units 18*a,* 18*b* can be increased, thereby reducing the contact resistance.

With such replaceable type edged electrode assembly, only those edged electrode units which have been deteriorated or fouled by corona discharge can be replaced with new unit parts. As a matter of course, the number of electrode edges for each replaceable electrode unit is not limited to one or three edges as illustrated in the embodiments, but two needles or any desired number of edges such as four or five edges may constitute a replaceable edged electrode unit.

As is now apparent from the foregoing description, according to the present invention, sliding the edged electrode plate by the aid of the guide groove provided in the charging device, the discharging electrode assembly can be removed from and inserted into the charging device as a unit part without the need to disassemble the charging device. Furthermore, removal and insertion of the discharging electrode assembly as unit part can be accomplished without removing the charging device from the process unit. Additionally, removal and insertion of the edged electrode plate as unit part can be accomplished without removing the process unit which includes the charging device from the electrophotographic apparatus.

Using the above-described attachment helps to facilitate the procedure of the removal and insertion of the discharging electrode assembly. The provision of the electrode plate holder, which is made of an insulating material and to which the edged electrode plate made of a thin plate and having a sawtooth-like electrode edges is fixedly mounted, can constitute a replaceable edged electrode plate assembly as a unit part capable of offering improved insulation, strength and slidability. The electrode plate holder of the edged electrode plate can double as a guide in inserting the edged electrode plate into the charging device and, inserting the edged electrode plate in the charging device by moving it along the guide groove of the insulating molded cases, the edged electrode plate can be position in place accurately, with the result that efficient corona discharging to the control grid and the photosensitive drum can be achieved. By designing the edged electrode plate in such a way that it includes a plurality of replaceable electrode units each having a single or a plurality of electrode edges, only those electrode units which have fouled electrode edges and hence unsuitable for proper corona discharging can be replaced easily with clean ones, thus contributing to reduction of cost in the maintenance of the charging device.

Furthermore, using the cleaning device which is adapted to clean the edged electrode plate when the latter is moved sliding in the charging device, the cleaning device does not have to move within the charging device. That is, the cleaning device is disposed stationary and includes a pair of cylindrical rotatable rollers which are disposed so as to sandwich the moving edged electrode plate adjacent to the opening through which the edged electrode plate is movable for insertion and removal. With such an arrangement, the paired cleaning rollers do not have to move within the charging device because the rollers are driven to rotate by the sliding movement of the edged electrode plate for cleaning the electrode plate. Because the cleaning device is designed as such, it is possible to install a stationary cleaning device, which can reduce the number of parts and save the space for installation.

Still furthermore, the provision of the scraping members (scrapers) for the cleaning rollers of the cleaning device for preventing accumulation of fouling makes possible efficient removal of the fouling from the cleaning rollers by scraping. Since the cleaning device is stationary and hence not movable within the charging device, the number of parts can be reduced accordingly, so that a mechanism for maintaining the cleaning performance of the space-saving cleaning rollers may be additionally provided. Though fouling particles scraped off the cleaning rollers may be dropped by their own weight, a basic charging performance of the photosensitive drum will not be affected by the scraped fouling particles, since the cleaning rollers of the cleaning device are provided outside the charging region.

As has been described in detail, the present invention can advantageously provide an electrostatic charging device, which is capable of easily inserting and removing the edged electrode plate into and from the charging device merely by sliding the edged electrode plate alone.

What is claimed is:

1. An electrostatic charging device for charging a photosensitive drum comprising:

an edged electrode member having a plurality of tooth-shaped electrode edges arranged in array along a longitudinal direction of and in facing relation to said photosensitive drum;

a discharge regulating member for regulating the region of corona discharging so that the corona discharge generated from said electrode edges is directed along the longitudinal direction of said photosensitive drum; and a mechanism for removably installing said edged electrode member in said discharge regulating member by slidably moving said edged electrode member relative to said discharge regulating member in a longitudinal direction thereof.

2. An electrostatic charging device according to claim 1, characterized by further comprising a control grid for controlling a condition of charging said photosensitive drum by the corona discharge.

3. An electrostatic charging device according to claim 1, characterized in that said removably installing mechanism includes a structure for supporting said edged electrode member so that said edged electrode member is insertable and removable with respect to a guide groove formed in said discharge regulating member.

4. An electrostatic charging device according to claim 1, characterized in that said discharge regulating member is supported by a cleaning process unit for cleaning said photosensitive drum by removing residual toner.

5. An electrostatic charging device according to claim 1, characterized in that said discharge regulating member is supported by the body of an electrophotographic apparatus which has incorporated therein a cleaning process unit for cleaning said photosensitive drum by removing residual toner.

6. An electrostatic charging device according to claim 1, characterized in that said edged electrode member has an engagement portion, which is engageable with an attachment made of insulating material and which is removably inserted into said discharge regulating member by said attachment.

7. An electrostatic charging device according to claim 1, characterized in that said edged electrode member is made of stainless steel and includes an electrode holder made of insulating material including PPE or polycarbonate, said edged electrode member being made integral with said electrode holder as a replaceable part.

8. An electrostatic charging device according to claim 1, characterized in that said edged electrode member includes electrode supports, each of which detachably supports a single or a plurality of units of said electrodes.

9. An electrostatic charging device according to claim 8, characterized in that said electrode supports are conductive with each other so that all of said electrodes can be applied with the same voltage.

10. An electrostatic charging device according to claim 1, characterized in that adjacent to an opening through which said edged electrode member is inserted, a rotatable roller is disposed to clean said edged electrode member when being rotated by sliding movement of said edged electrode member.

11. An electrostatic charging device according to claim 10, characterized in that said rotatable roller includes at least a pair of rotatable rollers which are disposed so as to sandwich therebetween said edged electrode member.

12. An electrostatic charging device according to claim 10, characterized by further comprising a scraper for scraping off fouling substances from said rotatable roller.

* * * * *